US010347092B2

(12) United States Patent
Dolezalek et al.

(10) Patent No.: US 10,347,092 B2
(45) Date of Patent: Jul. 9, 2019

(54) OMNI-DIRECTIONAL IN-LINE ILLUMINATION INDICATOR DEVICE

(71) Applicant: Banner Engineering Corp., Plymouth, MN (US)

(72) Inventors: Charles Dolezalek, Stacy, MN (US); William Theunissen, Maple Grove, MN (US)

(73) Assignee: Banner Engineering Corp., Plymouth, MN (US)

( * ) Notice: Subject to any disclaimer, the term of this patent is extended or adjusted under 35 U.S.C. 154(b) by 21 days.

(21) Appl. No.: 15/222,429

(22) Filed: Jul. 28, 2016

(65) Prior Publication Data

US 2018/0033260 A1 Feb. 1, 2018

(51) Int. Cl.

| | |
|---|---|
| ***G08B 5/36*** | (2006.01) |
| ***H01R 13/717*** | (2006.01) |
| ***H01R 13/66*** | (2006.01) |
| ***H05B 37/02*** | (2006.01) |
| *F21W 111/00* | (2006.01) |
| *F21Y 115/10* | (2016.01) |
| *F21Y 107/90* | (2016.01) |

(52) U.S. Cl.

CPC ..... *G08B 5/36* (2013.01); *H01R 13/6683* (2013.01); *H01R 13/7175* (2013.01); *H05B 37/02* (2013.01); *F21W 2111/00* (2013.01); *F21Y 2107/90* (2016.08); *F21Y 2115/10* (2016.08)

(58) Field of Classification Search

CPC .. G08B 5/36; H01R 13/7175; H01R 13/6683; H05B 37/02; F21Y 2107/90; F21Y 2115/10; F21W 2111/00

See application file for complete search history.

(56) References Cited

U.S. PATENT DOCUMENTS 5,359,290 A 10/1994 Cervas
5,644,462 A * 7/1997 Boschetto ..... H01R 13/717 340/641

(Continued)

OTHER PUBLICATIONS

Grace Engineered Products, Inc., Permanent Electrical Safety Devices (PESDs), Aug. 2014, Grace Engineered Products, Inc., Davenport, IA.

*Primary Examiner* — Patrick N Edouard
*Assistant Examiner* — Eboni N Hughes
(74) *Attorney, Agent, or Firm* — Craige Thompson; Thompson Patent Law

(57) ABSTRACT

Apparatus and associated methods relate to status indicator devices having a first releasably connectable electrical interface (RCEI) and second RCEI defining an axis from which an illumination module illuminates in substantially all radial directions with respect to the axis. In an illustrative example, an indicator device may include an illumination module and a detection module between the first RCEI and the second RCEI. An electrically conductive path along the axis may connect the first RCEI and the second RCEI. The detection module may be configured such that when the first RCEI receives a signal, the detection module may cause, in accordance with predetermined signal criteria, the illumination module to illuminate. In some examples, the status indicator may advantageously provide instantaneous remote visual indication of the predetermined signal criteria from substantially any viewing angle and at any point along a cable.

20 Claims, 7 Drawing Sheets

(56) References Cited

U.S. PATENT DOCUMENTS

| | | | | |
|---|---|---|---|---|
| 6,437,580 | B1 * | 8/2002 | Gale | G01R 31/021 324/508 |
| 6,975,209 | B2 | 12/2005 | Gromov | |
| 6,997,576 | B1 * | 2/2006 | Lodhie | H05B 33/0803 362/223 |
| 7,052,171 | B1 * | 5/2006 | Lefebvre | F21V 21/30 362/217.12 |
| 7,375,533 | B2 * | 5/2008 | Gale | H01R 31/06 324/538 |
| 7,581,982 | B2 | 9/2009 | Mehnert et al. | |
| 7,633,298 | B1 * | 12/2009 | Kan | G01R 31/026 324/555 |
| 7,738,787 | B2 | 6/2010 | Nakajima et al. | |
| 7,816,925 | B1 * | 10/2010 | Gale | G01R 31/021 324/543 |
| 8,147,758 | B2 | 4/2012 | Leach | |
| 9,052,350 | B2 | 6/2015 | Neti et al. | |
| 2009/0023329 | A1 | 1/2009 | Mehnert et al. | |
| 2010/0219344 | A1 | 9/2010 | Duckworth et al. | |
| 2010/0231910 | A1 | 9/2010 | Mavliev | |
| 2014/0210631 | A1 * | 7/2014 | Zavis | G01R 5/28 340/815.45 |
| 2015/0109802 | A1 * | 4/2015 | Chang | F21V 17/16 362/374 |
| 2015/0253362 | A1 | 9/2015 | Louzir et al. | |
| 2015/0276140 | A1 * | 10/2015 | Demuynck | F21V 23/06 362/223 |
| 2015/0372432 | A1 | 12/2015 | Hagemeier et al. | |
| 2016/0327227 | A1 * | 11/2016 | Green, Jr. | F21S 10/043 |
| 2017/0138574 | A1 * | 5/2017 | Garcia | F21V 15/04 |

* cited by examiner

OMNI-DIRECTIONAL IN-LINE ILLUMINATION INDICATOR DEVICE

TECHNICAL FIELD

Various embodiments relate generally to status indicator devices.

BACKGROUND

Electrical devices, such as sensors, are commonplace in a manufacturing environment. For example, a proximity sensor may be used in a variety of applications, such as, for example, a feedback control system to monitor the position of an actuated element in an automated process. A proximity sensor may also ensure that a potentially dangerous machine only operates when the user's hands are on the proximity sensors thereby guarding against the user being within a potentially dangerous area when the potentially dangerous machine is operating.

Some electrical devices include display panels to indicate a status of the electrical device. For example, a display panel may display text, such as "ON," when the corresponding electrical device is powered on.

SUMMARY

Apparatus and associated methods relate to status indicator devices having a first releasably connectable electrical interface (RCEI) and second RCEI defining an axis from which an illumination module illuminates in substantially all radial directions with respect to the axis. In an illustrative example, an indicator device may include an illumination module and a detection module between the first RCEI and the second RCEI. An electrically conductive path along the axis may connect the first RCEI and the second RCEI. The detection module may be configured such that when the first RCEI receives a signal, the detection module may cause, in accordance with predetermined signal criteria, the illumination module to illuminate. In some examples, the status indicator may advantageously provide instantaneous remote visual indication of the predetermined signal criteria from substantially any viewing angle and at any point along a cable.

Various embodiments may achieve one or more advantages. For example, some embodiments may be connected in-line between an electrical device and a controller such that the indicator device may be easily seen by a user. For example, in the event that an electrical device is disposed in a restricted area, the indicator device may be connected, along a wire, such that the indicator device is located in a more open area for increased visibility. In various embodiments, the illumination in all radial directions with respect to the axis may allow a user to view the illumination in any orientation of the indicator device. As such, the indicator device permits greater flexibility when being installed because the illuminations may be visible regardless of its orientation. In some embodiments, the indicator device may permit a user to more easily identify whether a connected electrical device, such as, for example, a thermal sensor, is powered "ON".

In various embodiments, a translucent material may be used to form a body housing of the indicator device such that when the illumination module illuminates the illumination may be seen through the translucent material. In some embodiments, the translucent material may be overmolded. In some embodiments, the body housing may be formed via welding halves together or via epoxy encapsulation. In various embodiments, the body housing may be formed in a cylindrical shape. The translucent material may be diffused such that the detection module and the illumination module may not be visible to a user. However, the diffused translucent material may permit light from the illumination to be visible.

In some embodiments, the illumination module may include one or more light-emitting diodes (LEDs). The LEDs may be different in color. For example, the illumination module may include green LEDs and yellow LEDs. The indicator device may receive a signal from a connected electrical device. In response to the received signal, the colored LEDs may each illuminate in accordance with one or more predetermined signal criteria. For example, the green LEDs may illuminate to indicate that a connected electrical device is powered "ON". In various embodiments, the LEDs may be customizable tri-colored LEDs such that a user may customize the color selections in accordance with the user's preferences.

In various embodiments, maintenance labor may be reduced with the use of the indicator device. For example, in the event multiple electrical devices, located in different areas, are being monitored, a user may quickly determine which electrical device is malfunctioning by remote visual inspection. In some embodiments, colored LEDs or specific flash patterns may indicate any of a number of specific conditions based on the signal characteristics in a cable, for example.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 4:
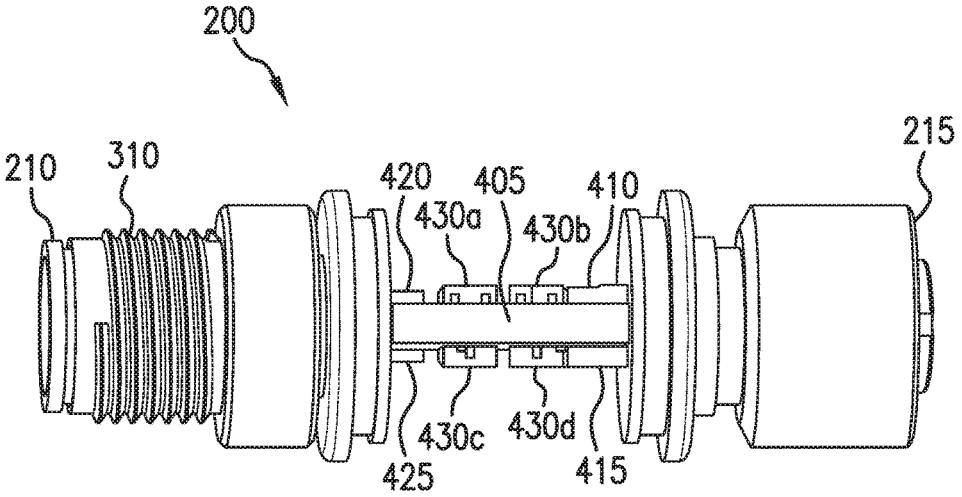
FIG. 4 depicts a side perspective view of an exemplary SID without a SID body.
Figure 5:
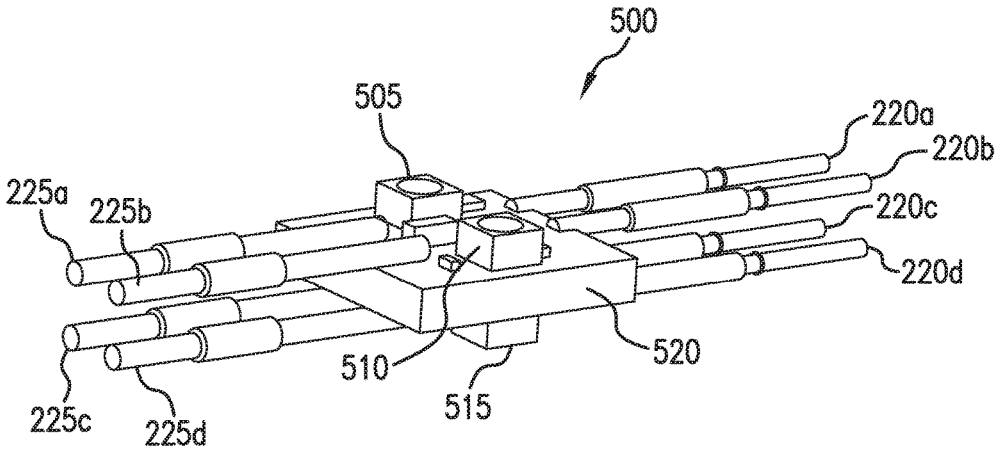
FIG. 5 depicts a perspective view of the interior of an exemplary SID.

To aid understanding, this document is organized as follows. First, the use of multiple exemplary status indicator devices (SIDs) are briefly introduced with reference to FIG. 1. Second, with reference to FIGS. 2A-3B, the discussion turns to exemplary embodiments that illustrate the exterior components of an exemplary SID. Specifically, the body housing and the releasably connectable electrical interfaces (RCEIs). With reference to FIGS. 4-5, the discussion turns to exemplary embodiments of the detection module and the illumination module of an exemplary SID. The discussion turns, with reference to FIGS. 6A-6D, to schematic layouts of an exemplary SID. Finally, with reference to FIG. 7, further explanatory discussion relates to an exemplary schematic diagram for an exemplary detection module.

Figure 1:
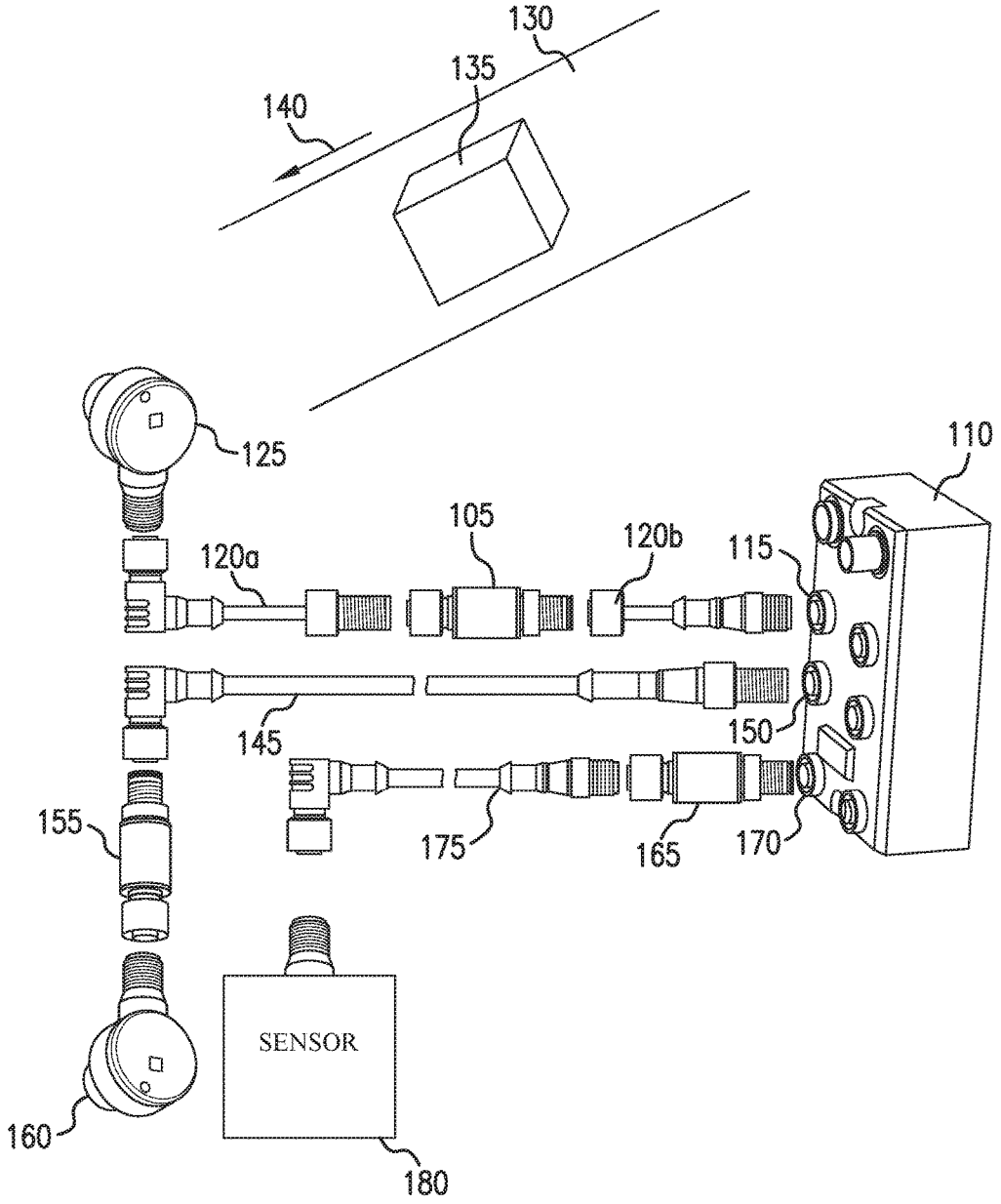
FIG. 1 depicts a perspective view of exemplary status indicator devices (SIDs) connected to multiple electrical devices.

FIG. 1 depicts a perspective view of exemplary status indicator devices (SIDs) connected to multiple electrical devices. A SID 105 releasably connects between a controller 110 and a sensing device 125, via wires 120*b*, 120*a*, respectively. As depicted, wire 120*a* electrically connects the SID 105 to the sensing device 125. Wire 120*b* electrically connects the SID 105 to the controller 110, at a port 115. The sensing device 125 may be in electrical communication, via the SID 105 and the electrical wires 120*a*, 120*b* to the controller 110. The SID 105 may receive, via the electrical wire 120*a*, an electrical signal from the sensing device 125. In response to the received signal, the SID 105 may illuminate according to one or more predetermined signal criteria.

For example, a conveyor belt 130 may transport a part 135 along a path 140. As depicted, the sensing device 125 is disposed along the path 140 such that when the part 135 aligns with the sensing device 125, the sensing device 125 transmits a signal, indicating that a presence has been detected, to the controller 110. As such, the SID 105, in response to the transmitted signal from the sensing device 125 to the controller 110, illuminates according to one or more predetermined signal criteria. As depicted, in the event that a user is near neither the controller 110 nor the sensing device 125, the user may determine, via remote visual inspection of the SID 105, a status of the sensing device 125 while at a remote location from the controller 110 or the sensing device 125. In some embodiments, the SID 105 may illuminate to indicate whether the sensing device 125 is operating, such as, for example, whether the sensing device 125 has operating power within a predetermined operating voltage range, for example.

A wire 145 releasably connects to the controller 110 at port 150. A SID 155 releasably connects to the wire 145 at an end opposite the controller 110. A sensing device 160 releasably connects to the SID 155. As depicted, in the event that a user is near the sensing device 160 and away from the controller 110, the user may determine, via the SID 155, a status of the signals going to and from the sensing device 160.

Also depicted in this example is a SID 165 that releasably connects between the controller 110, at port 170, and an electrical wire 175. The electrical wire 175 releasably connects to a sensor 180. The sensor 180 may be in electrical communication, via the SID 165 and the electrical wire 175, to the controller 110. The SID 165 may receive, via the electrical wire 175, an electrical signal from the sensor 180. In response to the received signal, the SID 165 may illuminate according to one or more predetermined signal criteria. In the event that a user is near the controller 110 and away from the sensor 180, the user may determine, via the SID 165, a status of the sensor 180 while at the controller 110.

Figure 2A:
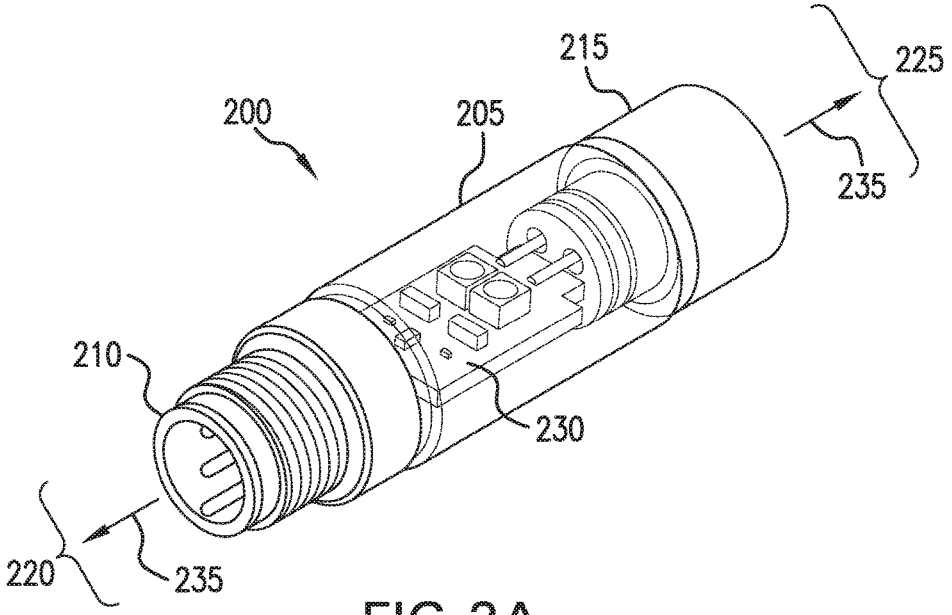
FIG. 2A depicts a perspective view of a terminal end of an exemplary SID.

FIG. 2A depicts a perspective view of a terminal end of an exemplary SID. A SID 200 includes a SID body 205 connected between a first mating interface 210 and a second mating interface 215 such that the first mating interface 210 and the second mating interface 215 form an axis 235. The first mating interface 210 includes a plurality of terminals 220 (e.g., plugs). The plurality of terminals 220 electrically connect to a detection module 230. The SID body 205 houses the detection module 230 along the axis 235. As depicted, the SID body 205 is constructed of a translucent material such that the detection module 230 may be omnidirectionally viewed through the SID body 205.

Figure 2B:
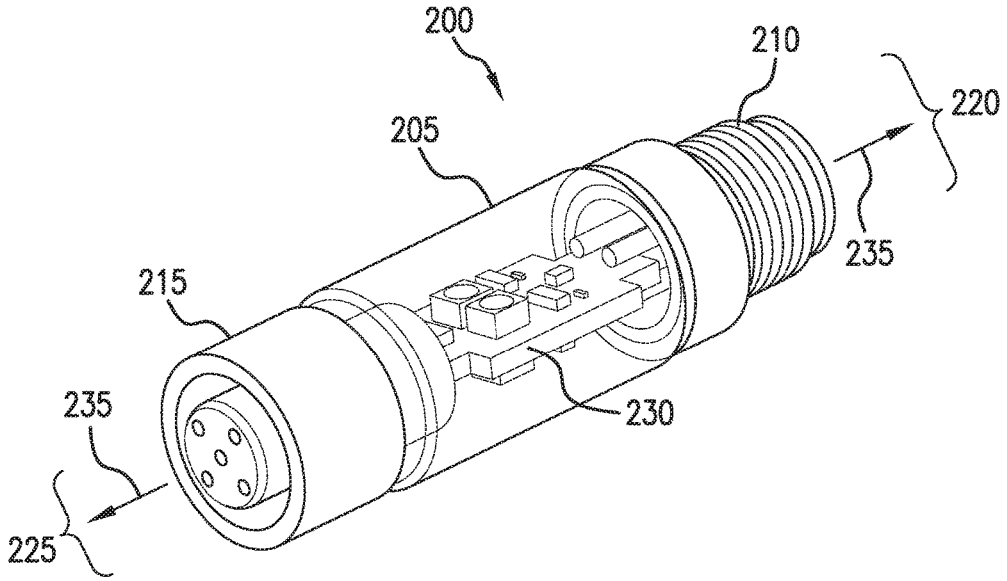
FIG. 2B depicts a perspective view of a channel end of an exemplary SID.

FIG. 2B depicts a perspective view of a channel end of an exemplary SID. As depicted, the second mating interface 215 includes a plurality of terminal channels 225 (e.g., sockets). The plurality of terminal channels 225 electrically connects to the detection module 230 such that an electrically conductive path, through the detection module 230 connects the plurality of terminal channels 225 and the plurality of terminals 220. In some embodiments, the electrically conductive path may pass through an electrical signal (e.g., bypass any components of the detection module 230) when traveling from the plurality of terminals 220 to the plurality of terminal channels 225. In various implementations, the SID 200 may illuminate in substantially all radial directions with respect to the axis 235. In an illustrative example, the first mating interface 210 may include multiple plugs such that both the first mating interface 210 and the second mating interface 215 would include corresponding arrangements of sockets to make electrical connections, for example. In some embodiments, the first mating interface 210 or second mating interface may comprise terminal block style connections (not shown), allowing the user to connect bare wire flying leads to the SID.

Figure 3A:
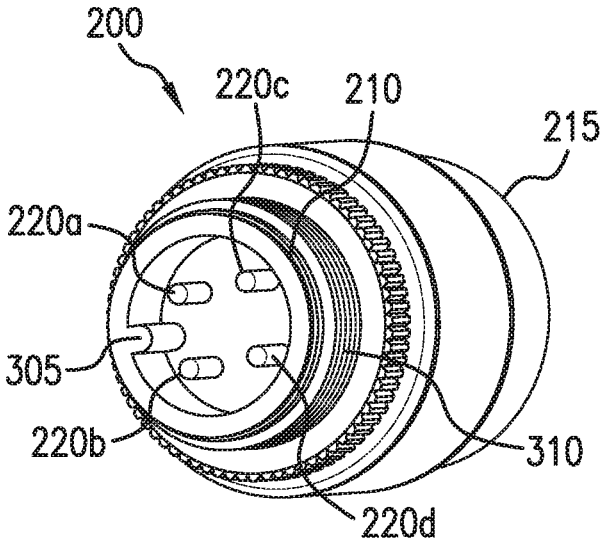
FIG. 3A depicts a perspective view of a plurality of terminals of an exemplary SID.

FIG. 3A depicts a perspective view of a plurality of terminals of an exemplary SID. The SID 200, at the first mating interface 210, includes terminals 220*a*-220*d*. The first mating interface 210 includes a projection key 305. As depicted, the first mating interface 210 includes an external screw thread 310 configured to releasably connect to a corresponding device. For example, a cable connector having a corresponding internal screw thread may be releasably connected to the SID 200 via the external screw thread 310.

Figure 3B:
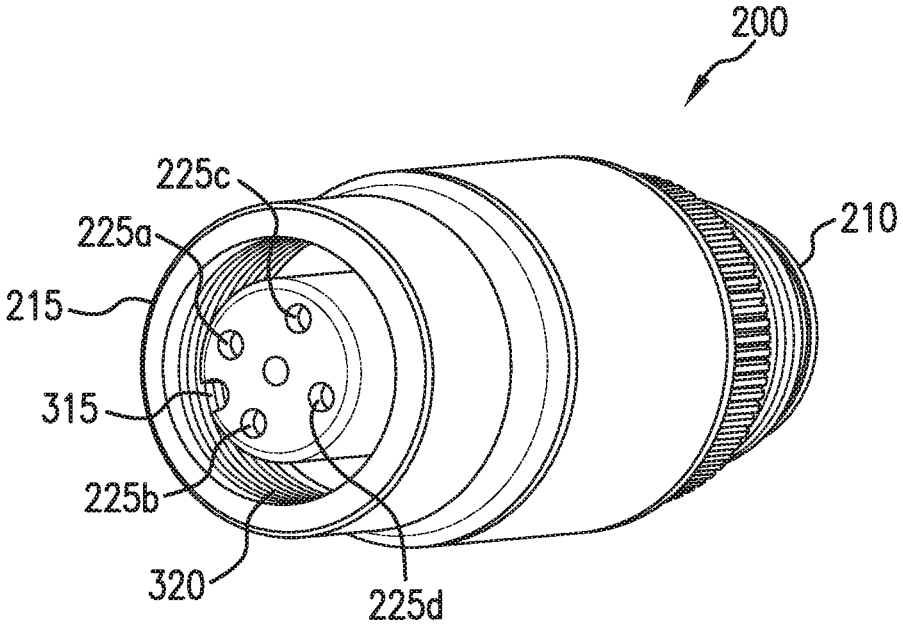
FIG. 3B depicts a perspective view of a plurality of terminal channels of an exemplary SID.

FIG. 3B depicts a perspective view of a plurality of terminal channels of an exemplary SID. The SID 200, at the second mating interface 215, includes terminal channels 225*a*-225*d*. The second mating interface 215 includes a depression slot 315 configured to receive a corresponding projection key, such as the projection key 305. When the depression slot 315 aligns with a projection key of a mating interface of a corresponding device (not shown), each terminal of the corresponding device may align with a terminal channel 225*a*-225*d*. In various examples, the corresponding device may be a controller such that the SID 200 electrically connects directly to the controller. In some embodiments, the corresponding device may be any compatible electrical wire. In various embodiments, the corresponding device may be a compatible electrical device, such as, for example, a photoelectrical sensor or a proximity sensor. The corresponding device may be determined in accordance with environmental criteria. For example, in a temperature sensitive manufacturing environment, the corresponding device may be a thermal sensor. In some embodiments, the corresponding device may be an ultrasonic sensor or a radar sensor.

As depicted, the SID 200 includes, at the second mating interface 215, an internal screw thread 320 configured to releasably connect to a corresponding device. In various embodiments, a corresponding device may include a corresponding external screw thread to releasably connect to the SID 200 at the second mating interface 215. By way of example and not limitation, the first mating interface 210 and the second mating interface 215 may comprise M12-type or M8-type connectors, for example. In some embodiments, the first mating interface 210 and the second mating interface 215 may have a clasp-and-lock type interface instead of the screw-type interfaces depicted in FIGS. 3A and 3B. Industry standard fasteners may also be used, such as, for example, BNC, Deutsch, M23 and/or USB.

FIG. 4 depicts a side perspective view of an exemplary SID without a SID body. As depicted, the first mating interface 210, having the external screw thread 310, electrically connects to a detection module 405 via terminal interface components 420, 425. The second mating interface 215 electrically connects to a detection module 405 via terminal interface components 410, 415. The detection module 405 includes a pair of light sources 430*a*, 430*b* on a surface of the detection module 405 and a pair of light sources 430*c*, 430*d* on an opposite surface of the detection module. In some embodiments, the light sources 430*a*-430*d* may be LEDs. In various embodiments, the light sources 430*a*, 430*c* may be green LEDs while the light sources 430*b*, 430*d* may be yellow LEDs such that when either the green LEDs or the yellow LEDs illuminate, the light travels omnidirectionally from the axis 235 (with reference to FIGS. 2A-2B).

FIG. 5 depicts a perspective view of the interior of an exemplary SID. A SID 500 includes a detection module 520 and an illumination module formed of the LEDs 505, 510, 515. The illumination module includes the pair of LEDs 505, 510 disposed on a first surface of the detection module 520. The illumination module further includes the pair of LEDs 515 (second LED of pair not shown) disposed on a second surface of the detection module 520. The terminal channels 225*a*-225*d* may include connection portions at each end of the terminal channels 225*a*-225*d* to permit soldering the terminal channels 225*a*-225*d* to the detection module 520. The terminals 220*a*-220*d* may include connection portions at each end of the terminals 220*a*-220*d* to permit soldering the terminals 220*a*-220*d* to the detection module 520 such that the terminal channels 225*a*-255*d* and the terminals 220*a*-220*d* are soldered to the detection module 520 at opposing ends along the axis 235 (with reference to FIGS. 2A-2B).

In some embodiments, the connection portions of the terminals 220*a*-220*d* and the terminal channels 225*a*-225*d* may be formed such that the connection portions may be electrically connected to the detection module 520 via a solder. In some embodiments, the conductive portions may include conductive glue. In various embodiments, the connection portions may be configured such that conductive plugs may electrically connect the terminals 220*a*-220*d* and the terminal channels 225*a*-225*d* to the detection module 520.

Figure 6A:
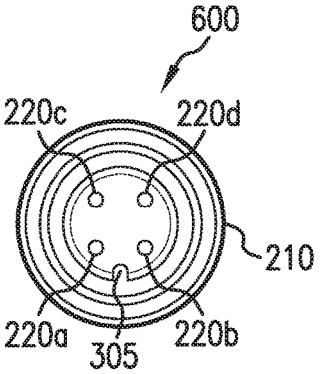
FIG. 6A depicts a schematic end view of a terminal end of an exemplary SID.

FIG. 6A depicts a schematic end view of a terminal channel end of an exemplary SID. A SID 600 includes the first mating interface 210. As depicted, the first mating interface 210 includes four terminals 220*a*-220*d* configured in a substantially square layout. The projection key 305 is disposed between and nearest to the terminal 220*a* and the terminal 220*b* such that a corresponding device, when connected, may align corresponding terminal channels, such as, for example, terminal channels 225*a*-225*d*, accordingly. In some embodiments, the terminals 220*a*-220*d* may be configured in various layouts. For example, the terminals 220*a*-220*d* may be configured in a triangular or circular layout.

In various embodiments, the number of terminals may be less than four. In some embodiments, the number of terminals may be greater than four. Each terminal 220*a*-220*d* may be configured such that each terminal transmits/receives a unique predetermined signal. For example, the terminal 220*a* may receive an operating power, the terminal 220*b* may receive a first predetermined signal, the terminal 220*c* may receive a second predetermined signal, and the terminal 220*d* may be ground.

Figure 6B:
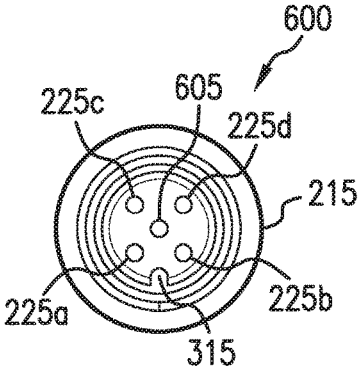
FIG. 6B depicts a schematic end view of a terminal channel end of an exemplary SID.

FIG. 6B depicts a schematic end view of a terminal channel end of an exemplary SID. The SID 600 includes the second mating interface 215. The second mating interface 215 includes four terminal channels 225*a*-225*d* configured in a substantially square layout. A fifth terminal channel 605 is disposed substantially centered with respected to the substantially square layout of terminal channels 225*a*-225*d*. A depression slot 315 is disposed between and nearest to the terminal channel 225*a* and the terminal channel 225*b* such that a corresponding device, when connected, may align corresponding terminals, such as, for example, terminals 220*a*-220*d*, accordingly.

In various embodiments, the number of terminal channels may vary. For example, the SID 600 may include two terminal channels, each terminal channel may be configured to receive different signals such as a power signal and a return signal. In various embodiments, the SID 600 may include three terminal channels to electrically connect to a device requiring a power signal, a return signal, and an input signal. An example of such a device may involve a sensor. Depending on the complexity of the electrically connected device, the SID 600 may include even more terminal channels. For example, various digital and/or analog sensing devices may include, for example, five or more terminal channels. In another example, a bridge sensor electrically connected to the SID 600 may have, for example, four wires. Each terminal channel 225*a*-225*d* may be configured to conduct a predetermined type of electrical signal (e.g., AC power, DC power, digital, analog, differential, single-ended).

Figure 6C:
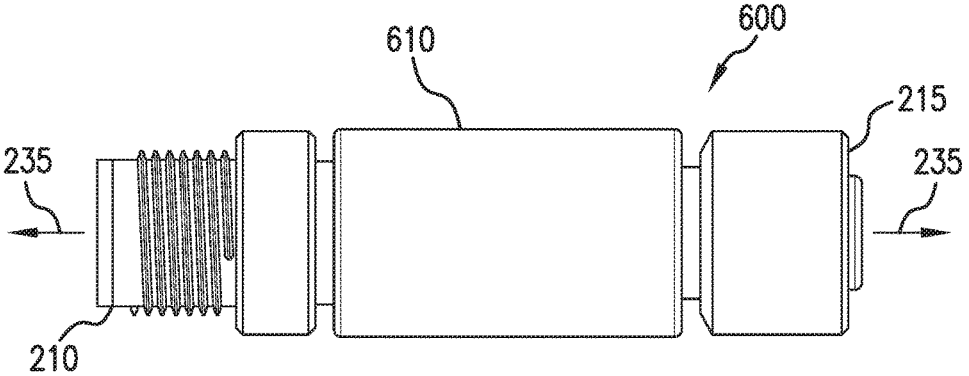
FIG. 6C depicts a schematic top view of an exemplary SID.

FIG. 6C depicts a schematic top view of an exemplary SID. The SID 600 includes a SID body 610. The SID body 610 connects between the first mating interface 210 and the second mating interface 215 along the axis 235. As depicted, the SID body 610 is opaque such that a detection module contained within the SID body 610 may not be seen. In some embodiments, the SID body 610 may be constructed via an overmolding process.

Figure 6D:
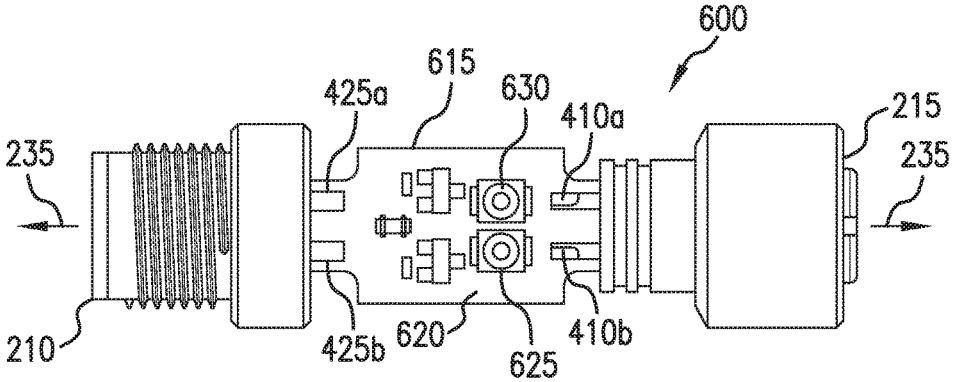
FIG. 6D depicts a schematic top view of a detection module of an exemplary SID.
Figure 7:
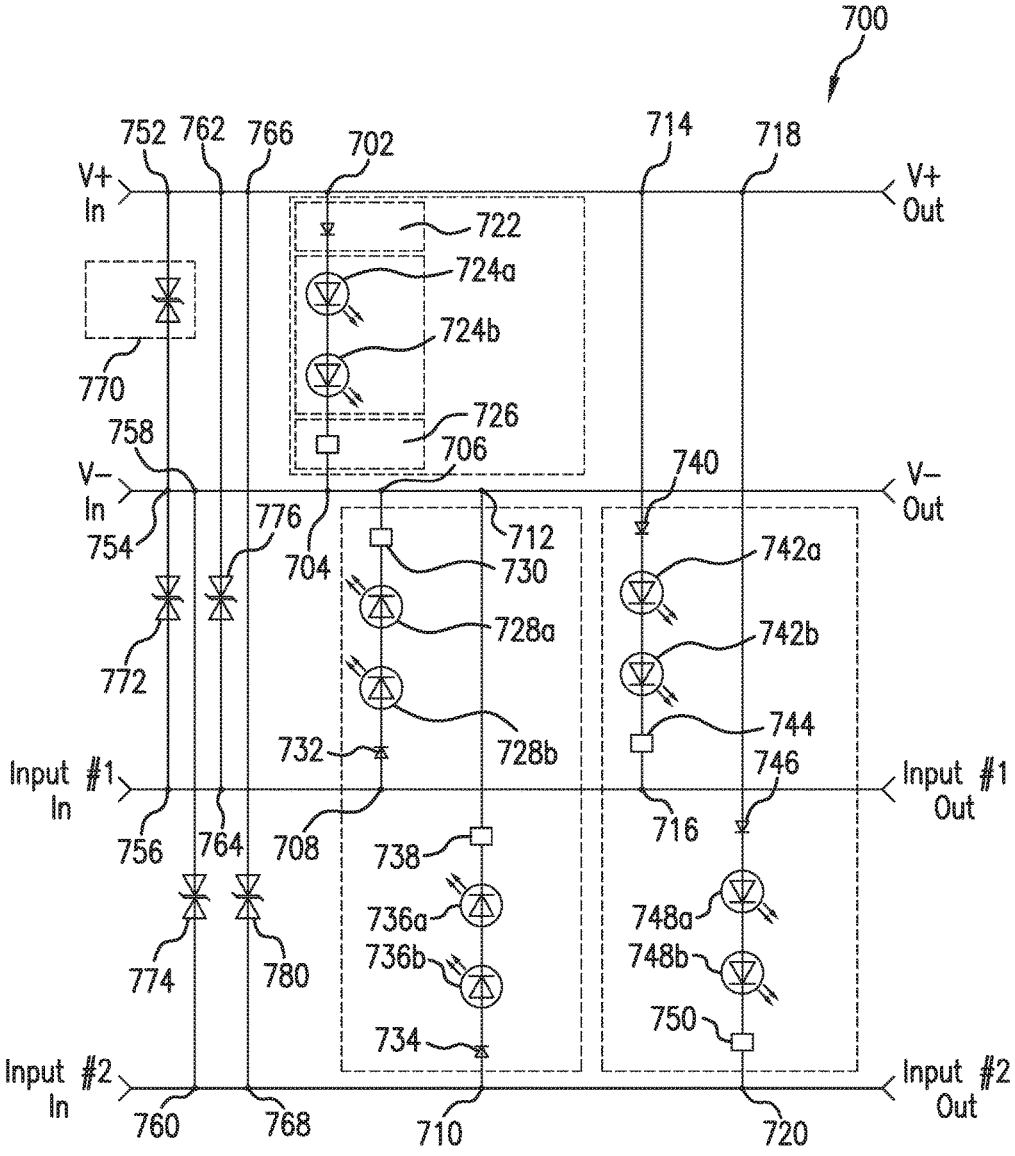
FIG. 7 depicts a schematic diagram of an exemplary detection module.

FIG. 6D depicts a schematic top view of a detection module of an exemplary SID. The SID 600 includes a detection module 615. As depicted, the terminals 220*a*-220*b* (not shown) electrically connect, via terminal interface components 425*a*-425*b*, to a first surface 620 of the detection module 615. The terminal channels 225*a*-225*b* (not shown) electrically connect, via terminal interface components 410*a*-410*b*, to the first surface 620 of the detection module 615. The detection module 615 includes a pair of light sources 625, 630. The light sources 625, 630 may be LEDs of predetermined colors. For example, the light source 625 may be green and the light source 630 may be yellow. In some embodiments, the detection module 615 may illuminate the light sources 625, 630 based on predetermined signal criteria. For example, a proximity sensor may be connected to the SID 600. The detection module 615 may receive, via one of the terminals 220*a*-220*d* (not shown), a detection signal from the proximity sensor. In response to the received detection signal, the detection module 615 may cause the LED 625 to illuminate green to indicate that the proximity sensor has detected an object. In the event no object has been detected by the proximity sensor, the detection module may illuminate the light source 630 yellow to indicate that the proximity sensor is operating but no object has been detected. 0043 FIG. 7 depicts a schematic diagram of an exemplary detection module. In the depicted example schematic, the detection module 700 includes four inputs, V+ in, V− in, Input #1in, and Input #2in. In various examples, the detection module may have any required number of inputs, and pass through signal paths for making connections from the inputs to a corresponding number of outputs. Between selected signal paths, detection circuitry may be provided to control the output radial illumination with respect to an axis (e.g., the axis 235 of FIG. 2A) in response to the selected electrical signal characteristics (e.g., voltage and/or current)

By way of example and not limitation, the detection module may employ analog or digital circuitry, which may include active and/or passive circuitry, or a combination thereof, to detect whether the selected signals meet one or more predetermined criteria. Based upon this detection, the detection circuitry may generate various illumination outputs to facilitate rapid visual detection and identification of the condition(s) associated with the predetermined criteria.

In some implementations, the predetermined criteria may be based on a differential voltage or current between two inputs. In some implementations, for example, the predetermined criteria may be based on a current in one of the signal paths, or a calculation of a real or imaginary voltage or current amplitude or phase parameter. In some embodiments, an illumination output signal may be activated in response to the detection circuitry monitoring more than two outputs, such as when summing multiple signal currents to determine a total current, for example. In some examples, an output illumination state may depend on the detection of a phase shift between two selected signals (e.g., voltage or current) falling within a predetermined limit or within a predetermined range.

Detection circuitry may be formed to evaluate signals against predetermined criteria using circuit elements that may include, but are not limited to, phase detectors, amplitude detectors, attenuators, high pass filters (e.g., AC-coupling), low pass filters, band-pass filters, notch filters, frequency detectors (e.g., phase-locked loops), digital counters, analog-to-digital conversion stages, amplifiers, rectifiers, multipliers, alone or in combination, for example. Constant current circuits (e.g., current mirrors), and voltage threshold detectors may be employed in the detection module, which may advantageously minimize power drain on the signal path(s) being monitored, for example. In some implementations, a programmed processor (e.g., ASIC, microcontroller) may monitor signals and generate the control signals to provide a specified illumination in response to the signal characteristics detected by the detection module of the SID.

Some embodiments of the SID module may output more than one illumination pattern to indicate more than one signal condition detected. For example, when the SID detects a certain signal amplitude below a first threshold, it may flash at 10 Hz, and when the SID detects the certain signal amplitude below a second threshold, it may flash at 25 Hz, and/or in a different color. By way of example, and not limitation, the illumination output may be coded or modulated by time (e.g., repetition rate, period, frequency, duty cycle, off time), amplitude (e.g., brightness), color (e.g., selected colors correspond to predetermined scenarios), or phase (e.g., sequencing, spacing of alternating flashing color), for example.

In some implementations, the SID may include a programmable module to receive updates to one or more previously programmed thresholds, or predetermined criteria, for example. In some examples, the SID may be subject to entering a programming state upon stimulating selected inputs with a programming mode activation key sequence. For example, a programmable resistor may be reprogrammed in situ to repurpose the SID for use with a new application that illuminates in response to different predetermined criteria. In some embodiments, the SID may be programmable (or readable) by wired or wireless (e.g., optical, electromagnetic field) communication through the housing or transparent overmolding, for example.

In some embodiments, each input may correspond to a terminal electrically connected to the detection module 700. For example, with reference to FIGS. 2A-2B, terminal 220*a* may receive V+ in, terminal 220*b* may receive V− in, terminal 220*c* may receive Input #1in, and terminal 220*d* may receive Input #2in. The detection module 700 includes four corresponding outputs, V+ out, V− out, Input #1out, Input #2out. In some embodiments, each corresponding output may correspond to a terminal channel electrically connected to the detection module 700. For example, with reference to FIGS. 2A-2B, terminal channel 225*a* may transmit V+ out, terminal channel 225*b* may transmit V− out, terminal channel 225*c* may transmit Input #1out, and terminal channel 225*d* may transmit Input #2out.

In the depicted schematic example of FIG. 7, the detection module 700 includes nodes 702, 714, 718, 752, 762, 766 disposed between V+ in and V+ out. The detection module 700 includes nodes 704, 706, 712, 754, 758 disposed between V− in and V− out. The detection module 700 includes nodes 708, 716, 756, 764 disposed between Input #1in and Input #1out. The detection module 700 includes nodes 710, 720, 760, 768 disposed between Input #2in and Input #2out.

The detection module 700 includes a first detection circuit disposed between node 702 and node 704. As depicted, the first detection circuit includes a series connection of a diode 722, a pair of LEDs 724*a*, 724*b*, and an electrical component 726. In various embodiments, the electrical component 726 may be a resistor. In some embodiments, the electrical component 726 may be, for example, a constant current source that is activated when the voltage differential between nodes 702, 704 is within a predetermined range. The diode 722 may be a reverse polarity diode. In various embodiments, the power components may receive a power operating signal from V+ in. In response to the received power operating signal, the pair of LEDs 724*a*, 724*b* may illuminate in accordance with a predetermined power operating signal criteria to indicate the power status of a connected corresponding device.

As depicted, the detection module 700 includes a second detection circuit connected between node 706 and node 708, to include a series connection of a diode 732, a pair of LEDs 728*a*, 728*b*, and an electrical component 730.

The detection module 700 further includes, between node 710 and node 712, a third detection circuit, to include a series connection of a diode 734, a pair of LEDs 736*a*, 736*b*, and an electrical component 738.

In an illustrative example, the second detection circuit that connects between node 706 and node 708 may receive a signal from Input #1in. In response to the received Input #1in signal being above a predetermined threshold voltage above V− in, the pair of LED's 728*a*, 728*b* may illuminate in accordance with one or more predetermined signal criteria to indicate the status of signals supplied to or from a connected corresponding device. In an example application, the connected corresponding device may be a pneumatic actuator.

The detection module 700 further includes a fourth detection circuit that connects between node 714 and node 716, to include a series connection of a diode 740, a pair of LEDs 742*a*, 742*b*, and an electrical component 744.

The detection module 700 further includes, between node 718 and node 720, a fifth detection circuit, to include a series connection of a diode 746, a pair of LEDs 748*a*, 748*b*, and an electrical component 750.

In various embodiments, each LED in the pair of LEDs of each of the detection circuits may be separately placed on opposite sides of the detection module (e.g., the detection module 405 of FIG. 4) so that their simultaneous and combined illumination radiates in substantially all radial directions with respect to the axis (e.g., the axis 235 of FIG. 2A). In an illustrative example, the LEDs 724*a*, 728*a*, 736*a*, 742*a*, and 748*a* may be located on one side of a printed circuit substrate (e.g., PCB) in the detection module 405 (as shown in FIG. 4), while the LEDs 724*b*, 728*b*, 736*b*, 742*b*, and 748*b* may be located on the opposite side of the printed circuit substrate.

As depicted, the detection module 700 includes a transient voltage suppressor 770 between node 752 and node 754. The detection module 700 further includes a transient voltage suppressor 772 between node 754 and node 756. The detection module 700 further includes a transient voltage suppressor 774 between node 758 and node 760. The detection module 700 further includes a transient voltage suppressor 776 between node 762 and node 764. The detection module 700 further includes a transient voltage suppressor 780 between node 766 and node 768. In various embodiments, the transient voltage suppressors 770-780 may protect the detection module 700 from transient overvoltage conditions (e.g., electrostatic discharge events) between any of the signal paths.

Although various embodiments have been described with reference to the Figures, other embodiments are possible. For example, a detection module may include a processor and non-volatile memory. The non-volatile memory may store a program of instructions containing predetermined signal criteria. The processor may execute the program of instructions stored in the non-volatile memory to generate an illumination command for an illumination module to illuminate an LED in accordance with the predetermined signal criteria.

In some embodiments, a SID may permit more easily determining the operating status of an electrical device. In various embodiments, a SID may be a sensor emulator. A SID may include a cylindrical housing configured to enclose a detection module that is electrically connected to a pair of terminals, each terminal disposed at opposite ends of the cylindrical housing. A detection module may include circuitry configured to determine whether a connected electrical device is powered "ON" and to determine an operating status of the connected electrical device.

In various embodiments, a detection module may include a network module. The network module may provide a communication path between the SID and a mobile electrical device (e.g., tablet). For example, the network module may be wireless such that status indicator information may be transmitted, via a wireless network, to a mobile electrical device. A user may, from a remote location, monitor the status indicator information from the mobile electrical device.

Suitable processors for the execution of a program of instructions include, by way of example and not limitation, both general and special purpose microprocessors, which may include a single processor or one of multiple processors of any kind of computer. Generally, a processor will receive instructions and data from a read-only memory or a random access memory or both. The essential elements of a computer are a processor for executing instructions and one or more memories for storing instructions and data. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits). In some embodiments, the processor and the member can be supplemented by, or incorporated in hardware programmable devices, such as FPGAs, for example.

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. An exemplary embodiment may be implemented in a computer system that includes a graphical user interface and/or an Internet browser. To provide for interaction with a user, some implementations may be implemented on a computer having a display device, such as an LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the first receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, and the computers and networks forming the Internet. Other implementations may transport messages by broadcasting to all or substantially all devices that are coupled together by a communication network, for example, by using Omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Fire wire, ATA/IDE, RS-232, RS-422, RS-485, 802.11 a/b/g, Wi-Fi, Ethernet, IrDA, FDDI (fiber distributed data interface), token-ring networks, or multiplexing techniques based on frequency, time, or code division. Some implementations may optionally incorporate features such as error checking and correction (ECC) for data integrity, or security measures, such as encryption (e.g., WEP) and password protection.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. An apparatus for indicating status information about an electrical machine, the apparatus comprising:

a first releasably connectable electrical interface;

a second releasably connectable electrical interface, wherein an axis is defined between the first releasably connectable electrical interface and the second releasably connectable electrical interface;

an electrically conductive path connecting a first input terminal of the first releasably connectable electrical interface to a first output terminal of the second releasably connectable electrical interface;

a detection module operatively coupled to the first and second releasably connectable electrical interfaces, the detection module comprising:

a first detection circuit configured to detect at least one first parameter of a first signal received at the first releasably connectable electrical interface; and, a second detection circuit configured to detect at least one second parameter of a second signal received at the second releasably connectable electrical interface; and, an illumination module operable to illuminate in substantially all radial directions with respect to the axis, the illumination module comprising a printed circuit substrate, a first LED operably coupled with the first detection circuit, and a second LED operably coupled with the second detection circuit, wherein:

the first LED illuminates in response to the first detection circuit detecting that the detected at least one first parameter of the first signal meets at least one first predetermined signal criteria, the second LED illuminates in response to the second detection circuit detecting that the detected at least one second parameter of the second signal meets at least one second predetermined signal criteria, and the apparatus is connected in-line between a sensor and a controller such that the first signal is received from the sensor and the second signal is received from the controller.

2. The apparatus of claim 1, wherein the at least one first parameter of the first signal comprises a first input signal voltage and the at least one first predetermined signal criteria comprises a differential voltage between the first input signal voltage and a reference voltage being greater than a predetermined threshold voltage difference.

3. The apparatus of claim 1, wherein the at least one first parameter of the first signal comprises a first input signal current and the at least one first predetermined signal criteria comprises a differential current between the first input signal current and a reference current being greater than a predetermined threshold current difference.

4. The apparatus of claim 1, wherein the at least one first predetermined signal criteria are based on a calculation of at least one of a voltage and current amplitude.

5. The apparatus of claim 1, wherein the at least one first predetermined signal criteria are based on a calculation of at least one of a voltage and current phase parameter.

6. The apparatus of claim 1, wherein the at least one first parameter of the first signal comprises a first phase parameter, and the at least one first predetermined signal criteria comprises a differential phase between the first phase parameter and a second phase parameter.

7. The apparatus of claim 1, wherein the at least one first predetermined signal criteria are based on a calculation of at least one of a voltage and current phase parameter.

8. The apparatus of claim 1, wherein at least one of the at least one first parameter of the first signal and at least one second parameter of the second signal are programmable.

9. The apparatus of claim 1, wherein the sensor comprises a proximity sensor, and the first signal is received from the proximity sensor.

10. An apparatus for indicating status information about an electrical machine, the apparatus comprising:

a first releasably connectable electrical interface;

a second releasably connectable electrical interface, wherein an axis is defined between the first releasably connectable electrical interface and the second releasably connectable electrical interface;

a detection module operatively coupled to the first and second releasably connectable electrical interfaces, the detection module comprising:

a first detection circuit configured to detect at least one first parameter of a first signal received at the first releasably connectable electrical interface; and, a second detection circuit configured to detect at least one second parameter of a second signal received at the second releasably connectable electrical interface; and, an illumination module operable to illuminate in substantially all radial directions with respect to the axis, the illumination module comprising a printed circuit substrate, a first LED operably coupled with the first detection circuit, and a second LED operably coupled with the second detection circuit, wherein:

the first LED illuminates in response to the first detection circuit detecting that the detected at least one first parameter of the first signal meets at least one first predetermined signal criteria, and, the second LED illuminates in response to the second detection circuit detecting that the detected at least one second parameter of the second signal meets at least one second predetermined signal criteria.

11. The apparatus of claim 10, wherein the at least one first parameter of the first signal comprises a first input signal voltage and the at least one first predetermined signal criteria comprises a differential voltage between the first input signal voltage and a reference voltage being greater than a predetermined threshold voltage difference.

12. The apparatus of claim 10, wherein the at least one first parameter of the first signal comprises a first input signal current and the at least one first predetermined signal criteria comprises a differential current between the first input signal current and a reference current being greater than a predetermined threshold current difference.

13. The apparatus of claim 10, wherein the at least one first predetermined signal criteria are based on a calculation of at least one of a voltage and current amplitude.

14. The apparatus of claim 10, wherein the at least one first predetermined signal criteria are based on a calculation of at least one of a voltage and current phase parameter.

15. The apparatus of claim 10, wherein the at least one first parameter of the first signal comprises a first phase parameter, and the at least one first predetermined signal criteria comprises a differential phase between the first phase parameter and a second phase parameter.

16. The apparatus of claim 10, wherein the at least one first predetermined signal criteria are based on a calculation of at least one of a voltage and current phase parameter.

17. The apparatus of claim 10, wherein at least one of the at least one first parameter of the first signal and at least one second parameter of the second signal are programmable.

18. The apparatus of claim 11, wherein the at least one first predetermined signal criteria comprise the first signal indicating that the proximity sensor has detected an object.

19. The apparatus of claim 11, wherein the at least one first predetermined signal criteria comprise the first signal indicating that the proximity sensor is operating and that no object has been detected by the proximity sensor.

20. An apparatus for indicating status information about an electrical machine, the apparatus comprising:

a first releasably connectable electrical interface comprising a projection key;

a second releasably connectable electrical interface comprising a depression slot, wherein an axis is defined between the first releasably connectable electrical interface and the second releasably connectable electrical interface;

a detection module operatively coupled to the first and second releasably connectable electrical interfaces, the detection module comprising:

a first detection circuit configured to detect at least one first parameter of a first signal received at the first releasably connectable electrical interface; and, a second detection circuit configured to detect at least one second parameter of a second signal received at the second releasably connectable electrical interface; and, an illumination module operable to illuminate in substantially all radial directions with respect to the axis, the illumination module comprising a printed circuit substrate, a first LED operably coupled with the first detection circuit, and a second LED operably coupled with the second detection circuit, wherein:

the first LED illuminates in response to the first detection circuit detecting that the detected at least one first parameter of the first signal meets at least one first predetermined signal criteria, and, the second LED illuminates in response to the second detection circuit detecting that the detected at least one second parameter of the second signal meets at least one second predetermined signal criteria.

* * * * *